US012404664B2

(12) United States Patent
Pilarczyk et al.

(10) Patent No.: US 12,404,664 B2
(45) Date of Patent: Sep. 2, 2025

(54) SHOWER DRAIN ASSEMBLIES

(71) Applicant: WCM Industries, Inc., Colorado Springs, CO (US)

(72) Inventors: Eric Pilarczyk, Colorado Springs, CO (US); William T. Ball, Colorado Springs, CO (US); Kevin Hogan, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 86 days.

(21) Appl. No.: 18/497,583

(22) Filed: Oct. 30, 2023

(65) Prior Publication Data

US 2025/0109579 A1 Apr. 3, 2025

Related U.S. Application Data

(60) Provisional application No. 63/587,279, filed on Oct. 2, 2023.

(51) Int. Cl.
*E03C 1/22* (2006.01)
*E03F 5/04* (2006.01)

(52) U.S. Cl.
CPC ..... *E03C 1/22* (2013.01); *E03F 5/0408* (2013.01); *E03F 5/0409* (2013.01); *E03C 2201/00* (2013.01)

(58) Field of Classification Search
CPC ..... E03C 1/22; E03F 5/0408; E03F 5/0409
See application file for complete search history.

(56) References Cited

U.S. PATENT DOCUMENTS 3,700,381 A * 10/1972 Deeke ..... E03C 1/20 4/288
3,893,919 A * 7/1975 Flegel ..... E04D 13/0409 210/166
4,092,745 A * 6/1978 Oropallo ..... E03F 5/0408 4/292
4,622,703 A * 11/1986 Cuschera ..... E03C 1/22 277/606

(Continued)

OTHER PUBLICATIONS https://www.familyhandyman.com/project/how-to-install-a-fiberglass-base-over-concrete/ retrieved May 14, 2024, 3 pages.

(Continued)

*Primary Examiner* — Kevin F Murphy

(57) ABSTRACT

Shower drain assemblies and their components are disclosed. In some examples, a shower drain assembly may include a shower drain, a retaining ring, a sealing ring assembly, or a combination thereof. The retaining ring may fit inside the shower drain, and the sealing ring assembly may fit inside the shower drain and on top of the retaining ring. In some other examples, a shower drain assembly may include a shower drain, a gasket, a compression ring assembly, or a combination thereof. The gasket may fit inside the shower drain, and the compression ring assembly may fit inside the shower drain and on top of the gasket. The shower drain assemblies may allow for fluid pressure testing of shower drain and pipe assemblies. The shower drain assembly may allow for fluid pressure testing of areas not previously tested or a lack of a need for caulking, among other improvements.

9 Claims, 9 Drawing Sheets

(56) References Cited

U.S. PATENT DOCUMENTS

| | | | | |
|---|---|---|---|---|
| 4,694,513 | A * | 9/1987 | Kiziah | E03F 5/0408 285/136.1 |
| 10,422,453 | B2 * | 9/2019 | Dallmer | E03F 5/0407 |

OTHER PUBLICATIONS https://www.oatey.com/products/oatey-brass-plastic-nocaulk-shower-drains-919640827, retrieved May 14, 2024, 4 pages.
https://fergusonprod.a.bigcontent.io/v1/static/465668_7414515_installation?_.gl=1*1fwxi99*_ga*NDU5MjQzODMzLjE3MTQ1Nz15MDg.*_ga_1VMXKX8WQ0*MTcxNDU3MzAyNi4xLjEuMTcxNDU3MzA4NC4yLjAuMA . . . retrieved May 14, 2024, 4 pages.

* cited by examiner

SHOWER DRAIN ASSEMBLIES

CROSS REFERENCE TO RELATED APPLICATION

This application claims the benefit of U.S. Provisional Application No. 63/587,279, filed Oct. 2, 2023, which application is incorporated herein by reference in its entirety.

INTRODUCTION

Water receptacles, such as shower pans, generally include a drain port located at their lowermost point. The drain port is interconnected to a drain pipe through which wastewater flows. Drain components connect the drain pipe with aesthetic fixtures that contribute to the look and feel of a bathroom. After installation of drain components, a pressure test is performed to determine if the components have formed a proper seal about the drain pipe.

It is with respect to this general technical environment that aspects of the present technology disclosed herein have been contemplated. Furthermore, although a general environment is discussed, it should be understood that the examples described herein should not be limited to the general environment identified herein.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In an aspect, the present application relates to a shower drain assembly, comprising: a shower drain comprising: an upper opening; a lower opening; a ledge having an upper surface and being substantially concentric with the upper opening and the lower opening of the shower drain; and inside threading; a retaining ring comprising a plurality of angled teeth, and wherein the retaining ring is configured to rest on the upper surface of the ledge of the shower drain; and a sealing ring assembly, the sealing ring assembly comprising: a test membrane; outside threading configured to couple to the inside threading of the shower drain; a plurality of grooves substantially concentric with the upper opening and the lower opening of the shower drain, each configured to receive an O-ring; an inside cylindrical surface; an outside cylindrical surface; and an opening through the sealing ring assembly extending radially from the inside cylindrical surface to the outside cylindrical surface, wherein a lower surface of the sealing ring assembly is configured to contact the retaining ring when the sealing ring assembly is threadingly mated to the shower drain.

In some examples, the sealing ring assembly further comprises a lower opening configured to receive a pipe, and wherein when the sealing ring assembly is threadingly mated with the shower drain, there is a first gap between the top of the pipe and the test membrane of the sealing ring assembly.

In some examples, the pipe comprises a cylindrical outside surface, and wherein when the sealing ring assembly is threadingly mated with the shower drain, there is a second gap between the cylindrical outside surface of the pipe and at least a portion of the inside cylindrical surface of the sealing ring assembly.

In some examples, the inside cylindrical surface of the sealing ring assembly is divided into a first surface and a second surface, wherein the first surface is radially offset from the second surface, and wherein the second gap is between the cylindrical outside surface of the pipe and the first surface of the inside cylindrical surface of the sealing ring assembly.

In some examples, the shower drain assembly further comprises a plurality of O-rings, wherein the plurality of O-rings comprises a first-O-ring configured to contact the shower drain and the sealing ring assembly to create a first seal, and a second O-ring configured to contact the pipe and the sealing ring assembly to create a second seal.

In some examples, the pipe comprises a cylindrical outside surface, and wherein the opening, at the inside cylindrical surface of the sealing ring assembly, is fluidly coupled with an inside of the pipe via the first gap and via a second gap between the cylindrical outside surface of the pipe and at least a portion of the inside cylindrical surface of the sealing ring assembly.

In some examples, the opening, at the outside cylindrical surface of the sealing ring assembly, is located between two of the grooves, including at least one outwardly facing groove and at least one inwardly facing groove.

In some examples, the sealing ring assembly comprises one or more holds.

In some examples, the sealing ring assembly has a lower surface at an angle that is substantially a same angle as the plurality of angled teeth.

In another aspect, the present application relates to a sealing ring assembly for a shower drain, the sealing ring assembly comprising: a test membrane covering an upper opening of the sealing ring assembly; a plurality of grooves, each substantially concentric with the upper opening of the sealing ring, and each configured to receive an O-ring; an inside cylindrical surface; an outside cylindrical surface; and an opening through the sealing ring extending radially from the inside cylindrical surface to the outside cylindrical surface, wherein the opening fluidly connects the inside cylindrical surface to the outside cylindrical surface.

In some examples, the inside cylindrical surface of the sealing ring assembly is divided into a first surface and a second surface, and wherein the first surface is radially offset from the second surface.

In some examples, the opening, at the outside cylindrical surface of the sealing ring assembly, is located between two of the grooves, including at least one outwardly facing groove and at least one inwardly facing groove.

In some examples, the sealing ring assembly comprises one or more holds.

In some examples, the sealing ring assembly comprises outside threading.

In some examples, the sealing ring assembly further comprises a lower surface at an angle configured to frictionally contact a plurality of angled teeth of a retaining ring, the angle of the lower surface having substantially a same angle as the plurality of angled teeth.

In another aspect, the present application relates to a shower drain assembly, comprising: a shower drain comprising: an inside lower cylindrical surface; and inside threading adjacent to the inside lower cylindrical surface; a gasket having a substantially cylindrical shape, the gasket configured to fit inside the shower drain and configured to contact the inside lower cylindrical surface of the shower drain, and the gasket comprising an upper surface; and a compression ring assembly configured to fit inside the shower drain, the compression ring assembly comprising: a test membrane covering an upper opening of the compression ring assembly, wherein the test membrane is longitudinally offset from the gasket; and outside threading configured to couple to the inside threading of the shower drain, wherein when the outside threading is coupled to the inside threading of the shower drain, a lower surface of the compression ring assembly is configured to contact the upper surface of the gasket.

In some examples, the shower drain further comprises a lower opening, wherein a top of a pipe is configured to fit inside the lower opening of the shower drain and through the gasket, and wherein when the outside threading is coupled to the inside threading of the shower drain, the test membrane is longitudinally offset from the top of the pipe.

In some examples, the gasket comprises an inside surface, and wherein the inside surface of the gasket comprises a plurality of concentric grooves, wherein each groove is longitudinally offset from one another.

In some examples, the compression ring assembly comprises one or more holds.

In some examples, the lower surface of the compression ring assembly is configured to contact the upper surface of the gasket at an angle so that, when the compression ring assembly is threadingly mated to the shower drain, the upper surface of the gasket is deflected radially inward.

It is to be understood that both the foregoing general description and the following Detailed Description are explanatory and are intended to provide further aspects and examples of the disclosure as claimed.

BRIEF DESCRIPTION OF THE DRAWINGS

The following drawing figures, which form a part of this application, are illustrative of aspects of systems and methods described below and are not meant to limit the scope of the disclosure in any manner, which scope shall be based on the claims.

Figure 1A:
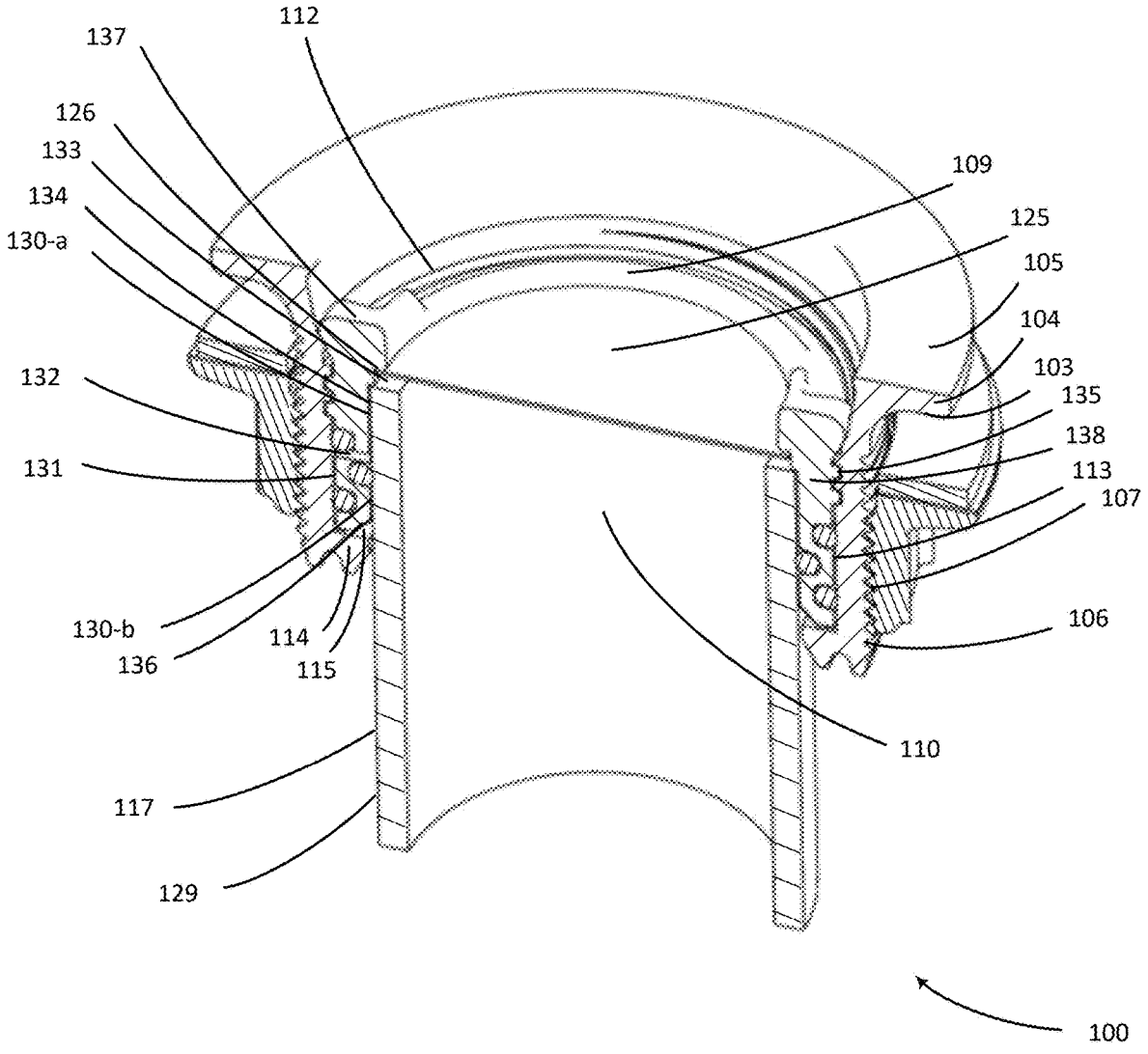
FIG. 1A is a cross-sectional, perspective view of a shower drain assembly with multiple components.

While examples of the disclosure are amenable to various modifications and alternative forms, specific aspects have been shown by way of example in the drawings and are described in detail below. The intention is not to limit the scope of the disclosure to the particular aspects described. On the contrary, the disclosure is intended to cover all modifications, equivalents, and alternatives falling within the scope of the disclosure and the appended claims.

DETAILED DESCRIPTION

As discussed briefly above, water receptacles, such as showers, generally include a drain port located at their lowermost point. The drain port is interconnected to a drain pipe or piping through which wastewater flows. During installation of drain components, a pressure test is performed to determine if the components have formed a proper seal about the drain pipe.

In particular, after a drain assembly is installed, the drain assembly may be pressure-tested to determine if the components of the drain assembly are properly sealed. In some situations, a membrane is used to perform this test. A fluid (e.g., water, air) may be forced through a pipe to the drain assembly for contact with the test membrane. Seals at different parts of the drain assembly are tested for fluid leaks. However, some parts of the drain assembly are not currently tested, or are not sufficiently tested, for sealing. Additionally, some drain assemblies may require caulking, which may introduce blockages, unsightly appearances, difficulty of removal, potential health risks, and may be a temporary solution, among other issues.

According to examples described herein, a shower drain assembly may include a shower drain, a retaining ring, and a sealing ring assembly. The retaining ring may fit inside the shower drain, and the sealing ring assembly may fit inside the shower drain and on top of the retaining ring. A test membrane may cover the top of the sealing ring assembly for fluid pressure testing of the shower drain assembly. The sealing ring assembly may receive O-rings designed to create seals between the sealing ring assembly and the shower drain, and between the sealing ring assembly and a pipe fitted inside the shower drain assembly. An opening (e.g., a duct) may provide a pathway for fluid provided to an outside surface of the sealing ring assembly to test seals (e.g., O-ring seals) between the shower drain and the sealing ring assembly.

In some other examples, a shower drain assembly may include a shower drain, a gasket, and a compression ring assembly. The gasket may fit inside the shower drain, and the compression ring assembly may fit inside the shower drain and on top of the gasket. A test membrane may cover the top of the sealing ring assembly for fluid pressure testing of the shower drain assembly.

The shower drain assemblies described herein may allow for fluid pressure testing of shower drain and pipe assemblies. Some shower drain assemblies described herein may allow for fluid pressure testing of areas of the shower drain assembly not previously tested. Some shower drain assemblies described herein may not require caulking, mitigating the negative effects of caulking previously discussed.

Figure 1B:
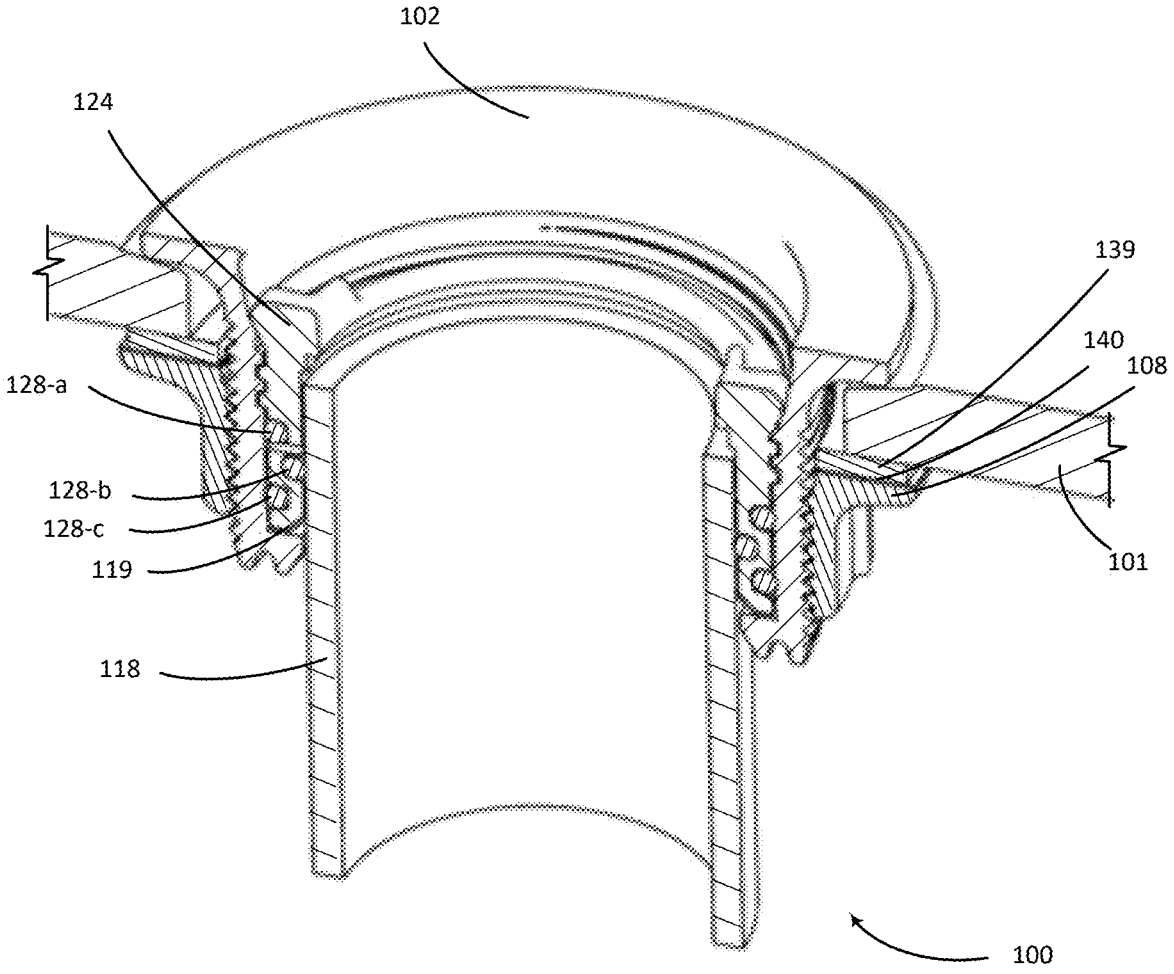
FIG. 1B depicts a cross-sectional, perspective view of the shower drain assembly of FIG. 1A secured about a shower pan.
Figure 1C:
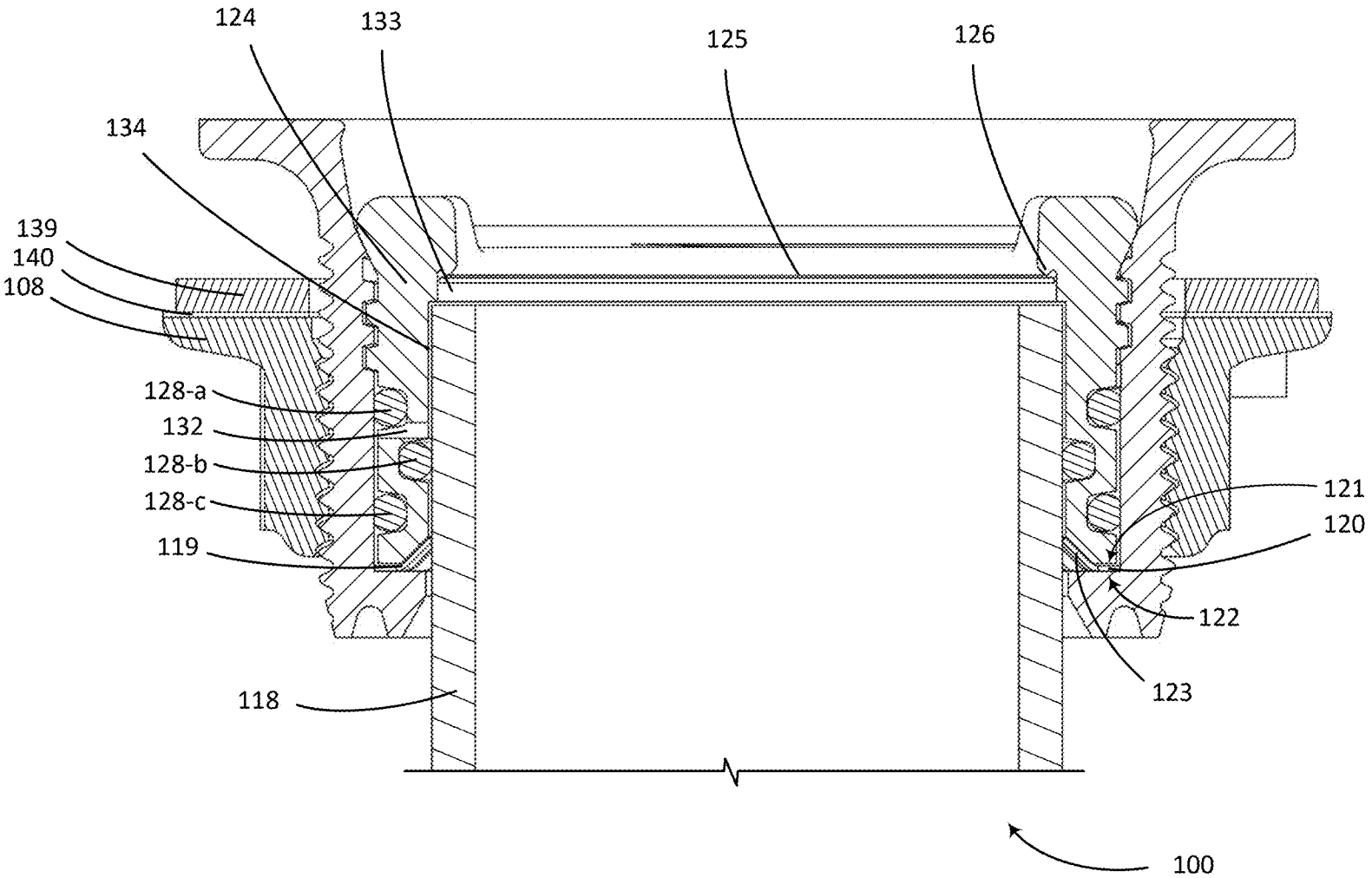
FIG. 1C depicts a cross-sectional, front view of the shower drain assembly of FIG. 1A.

FIGS. 1A-1C show diagrams illustrating shower drain assembly 100 with multiple components. FIG. 1B illustrates shower drain assembly 100 secured about a shower pan 101 and with the test membrane removed. Shower pan 101 may be composed of a variety of materials, such as plastic, ceramic, or metal. Design modifications to the disclosed systems may also be made to adapt the drain assembly 100 to be secured about a tile shower or other securing surface other than shower pan 101. With regard to FIG. 1B and FIG. 1C, repeated discussion of similar features will be omitted for brevity.

Figure 2A:
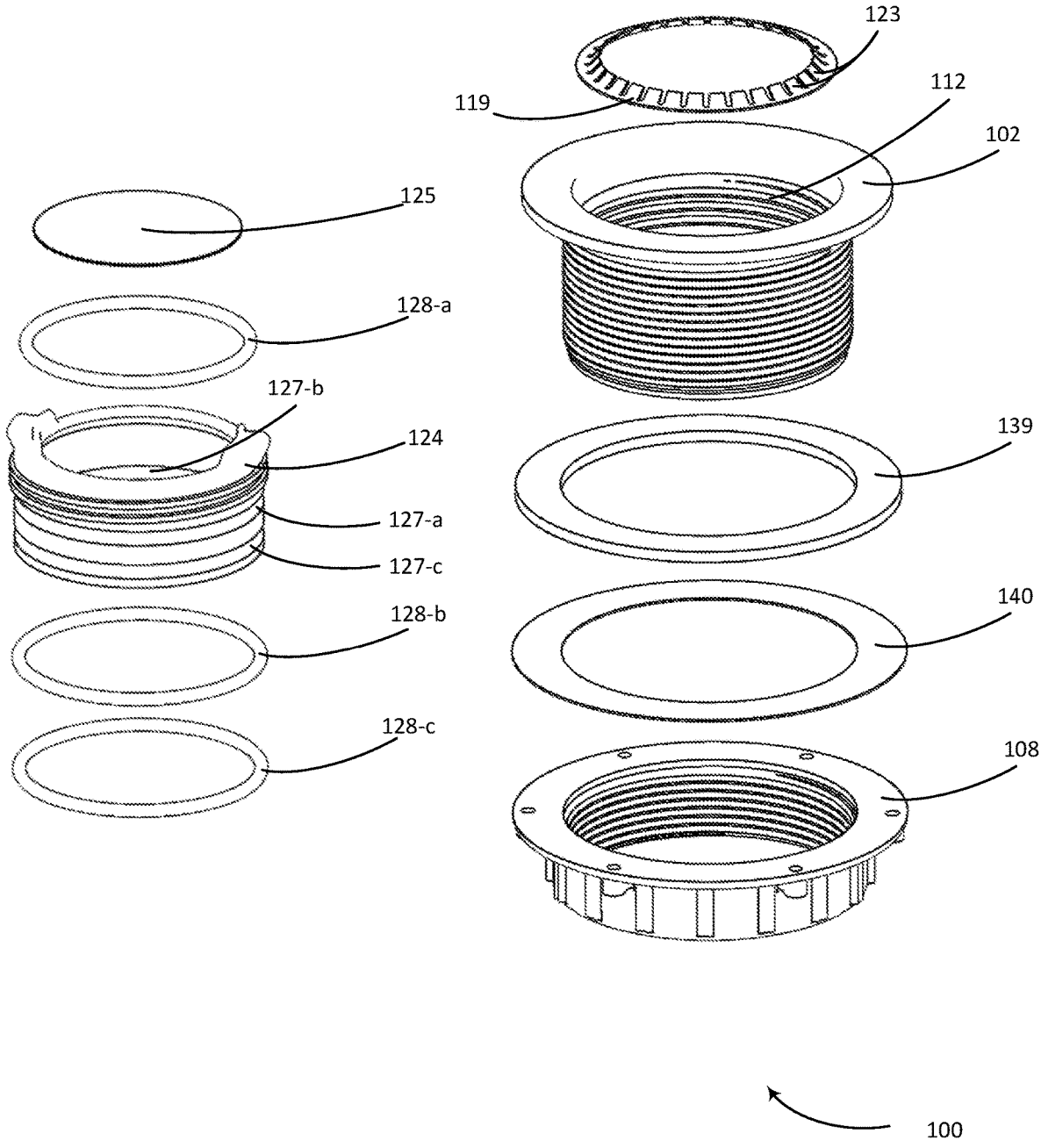
FIG. 2A shows an exploded view of one or more components for the drain assembly of FIGS. 1A-1C.
Figure 2B:
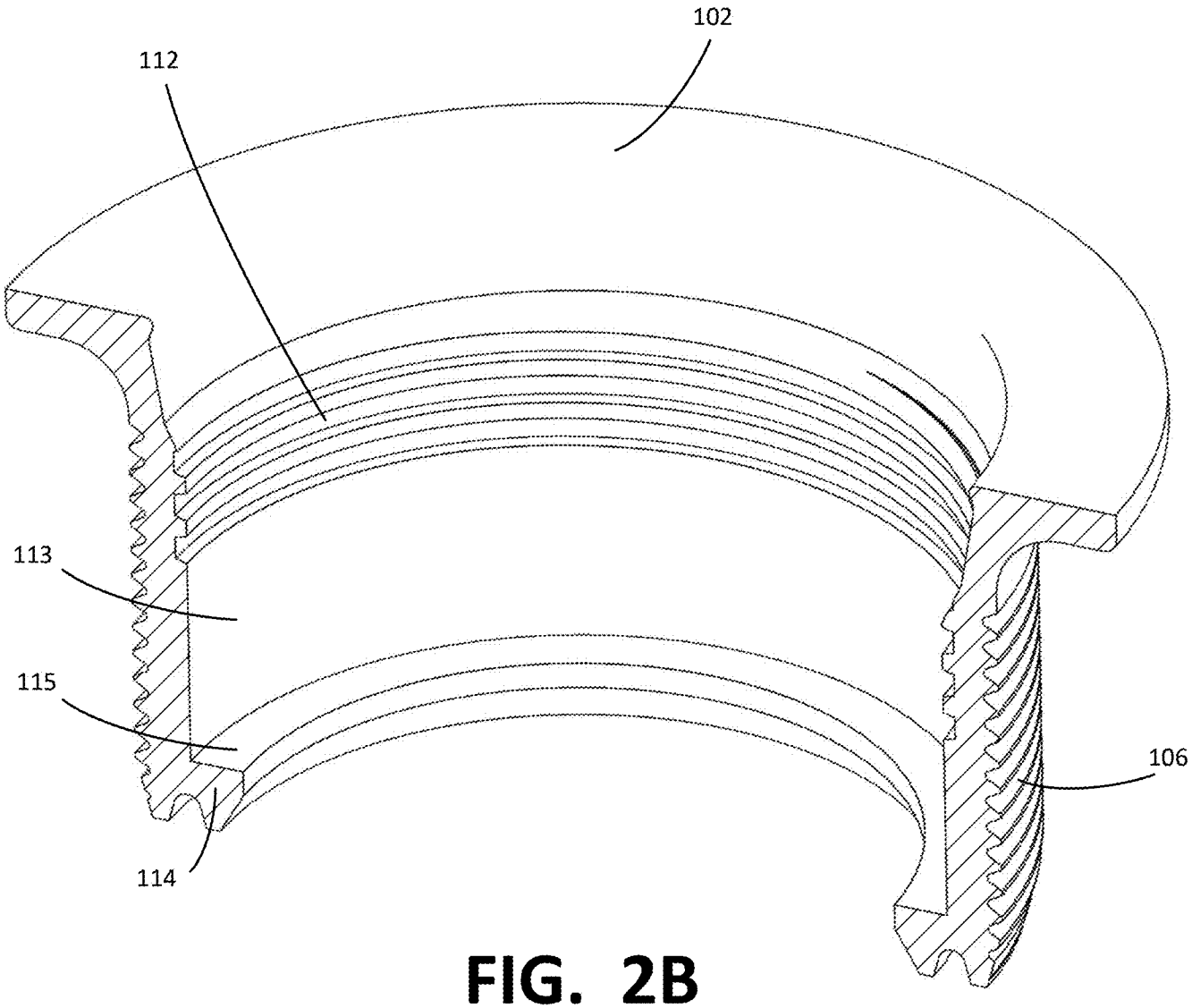
FIG. 2B depicts a cross-sectional, perspective view of certain components of the drain assembly of FIG. 2A.
Figure 2C:
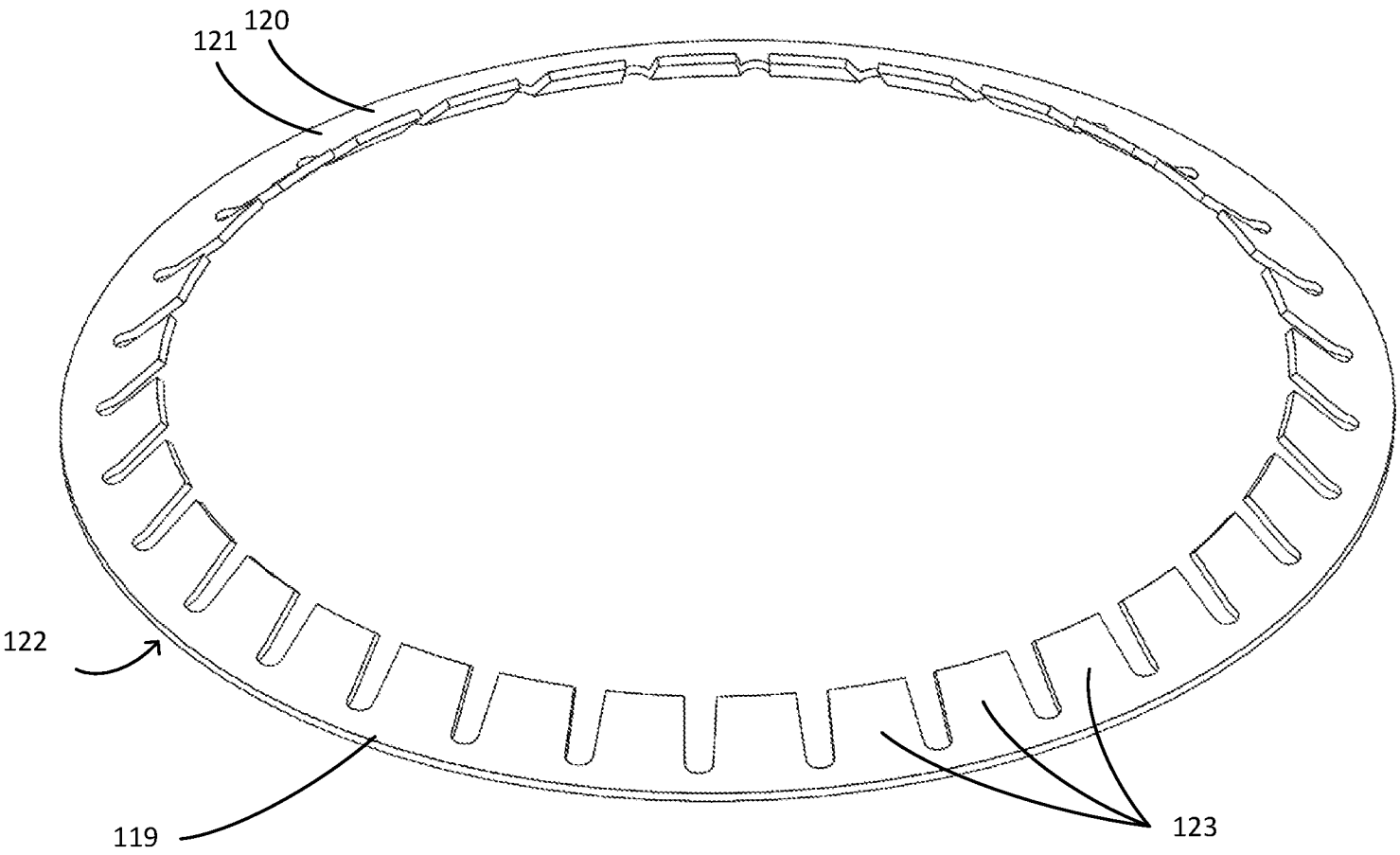
FIG. 2C depicts a perspective view of certain components of the drain assembly of FIG. 2A.

FIG. 2A shows an exploded view of one or more components for the drain assemblies of FIGS. 1A-1C. FIGS. 2B and 2C show components of the exploded view of FIG. 2A. Repeated discussion of similar features will be omitted for brevity.

Referring concurrently to FIGS. 1A, 1B, 1C, 2A, 2B, and 2C, shower drain assembly 100 may include shower drain 102. When the shower drain 102 is secured about a shower pan 101, the securing surface 103 comprising the underside of the flange 104 may be positioned to exert a force downward onto a top surface of the shower pan 101. The top surface 105 of the flange 104 may be exposed above the shower pan 101. As shown, the top surface 105 comprises a ring with an exterior diameter and an interior diameter. A threaded portion 106 of the shower drain 102 extends below the securing surface 103 downward opposite the top surface 105 of the flange 104. The threaded portion 106 is sized and shaped (e.g., having an appropriate external thread diameter of the threaded portion 106) to extend through a hole in the shower pan (e.g., a drain port) and thread into the internal threads 107 of the receptor 108. The internal diameter of the internal threads 107 of the receptor 108 are configured to cooperate with the external threads of the threaded portion 106 to secure the shower drain 102 to the shower pan 101. The shower drain 102 may include an upper opening 109 and a lower opening 110. The cavity formed through shower drain 102 may be substantially cylindrical. Shower drain 102 may also include internal threading 112. Shower drain 102 may include an internal cylindrical surface 113 adjacent to threading 112. The cross section of cylindrical surface 113 may be substantially concentric with the upper opening 109 and/or lower opening 110. Shower drain 102 may include a ledge 114 protruding inwards of the cylindrical surface 113. Ledge 114 may be adjacent to cylindrical surface 113. Ledge 114 may include a surface 115 substantially perpendicular to cylindrical surface 113. Surface 115 may be adjacent to cylindrical surface 113. Ledge 114 may include an internal diameter equal to or greater than an outside diameter 117 of pipe 118. The ledge 114 may be configured to frictionally contact pipe 118. Pipe 118 may be constructed from a material such as plastics polyvinyl chloride (PVC) or acrylonitrile butadiene styrene (ABS).

Shower drain assembly 100 may include a retaining ring 119. Retaining ring 119 may include a substantially flat portion 120, which may include a top surface 121 and a bottom surface 122. In some examples, a diameter of retaining ring 119 (e.g., any diameter of retaining ring 119, for example, an outside diameter of retaining ring 119, or an inside diameter of retaining ring 119) may be greater than outside diameter 117 of pipe 118. Retaining ring 119 may include one or more angled teeth 123. Angled teeth 123 may be at an angle (e.g., an obtuse angle) to flat portion 120. In some examples, angled teeth 123 may face substantially inwards of the retaining ring 119. In some other examples, retaining ring 119 may include one or more grooves (e.g., defining the negative space of the angled teeth 123). Each of the one or more grooves may begin from the inside diameter of the retaining ring 119 and extend outward to the outside diameter of the retaining ring 119. Each of the grooves may include a circular groove at the termination point of the groove. When the retaining ring 119 is installed in the shower drain assembly 100, and the shower drain assembly is installed about a pipe 118, angled teeth 123 may be in contact with pipe 118. For example, angled teeth 123 may restrict longitudinal movement of pipe 118 by frictionally gripping onto pipe 118. Retaining ring 119 may be in contact with ledge 114 of shower drain 102. For example, when installed, bottom surface 122 of retaining ring 119 may be in contact with surface 115 of ledge 114.

Shower drain assembly 100 may include a sealing ring assembly 124. Sealing ring assembly 124 may include a membrane 125 to prevent fluid flow through the shower drain assembly 100. The membrane 125 may be coupled (e.g., removably coupled) to the sealing ring assembly 124 to facilitate pressure testing of the shower drain assembly 100 after installation about the shower pan 101. The membrane 125 may be composed of a flexible or elastomeric material, such as PVC, ABS, or the like. In some examples, the membrane 125 may have a thickness less than 3 mm, less than 2 mm, or less than 1 mm. Membrane 125 may couple to sealing ring assembly 124 to cover an upper opening of the sealing ring assembly, as shown. The coupling may secure the membrane 125 to the sealing ring assembly 124 until removal of the membrane 125 is required or desired (e.g., after pressure testing). In some examples, the membrane 125 may be coupled to the sealing ring assembly 124 via a variety of mechanisms, such as with friction, with an adhesive, using sonic welding, or other mechanism or combination of mechanisms for coupling the membrane 125 with the sealing ring assembly 124. In some examples, sealing ring assembly 124 and membrane 125 may be made from a same material, may form a single integrated part (e.g., may be made as one piece), or both. For example, sealing ring assembly 124 and membrane 125 may be plastic molded as a single integrated part (e.g., with a groove/break line) to be broken apart once a pressure test is complete.

Describing an example where a membrane 125 is frictionally coupled to the sealing ring assembly 124, the frictional coupling may be based on a thickness of the membrane. For instance, a membrane 125 of greater thickness may frictionally engage with the sealing ring assembly 124 if the thickness of the membrane 125 provides stiffness sufficient to prevent the membrane 125 from being pushed through the sealing ring assembly 124 during a pressure test.

In a different example, a membrane 125 may be coupled to the sealing ring assembly 124 with an adhesive (e.g., liquid, paste, film, tape, etc.). The adhesive may allow for the membrane 125 to decouple from the sealing ring assembly 124 under certain strain. For instance, an adhesive bond between the membrane 125 and the sealing ring assembly 124 may break when a force exceeding a threshold (e.g., a force greater than that applied during a pressure test) is applied to the membrane 125. In another instance, an adhesive bond between the membrane 125 and the sealing ring assembly 124 may weaken or release under a change in temperature (e.g., applying heat). Other strains may be applied to an adhesive to otherwise allow the membrane 125 to be decoupled from the sealing ring assembly 124.

Alternatively, the membrane 125 may be coupled to the sealing ring assembly 124 via sonic welding. During sonic welding, the material of the membrane 125 is solid-state welded with a high-frequency vibratory energy while the welded pieces are held together under pressure. Sonic welding produces a bond between the materials of the two welded components without melting the base material. In some examples, the membrane 125 is sonically welded to the sealing ring assembly 124 with a horn applying a physical force and energy in the form of high-frequency vibrations to the membrane 125. Under the physical force (e.g., pressure) and energy exerted by the horn, the membrane 125 forms a removable weld sealing ring assembly 124. Aspects of securing a membrane to an overflow system are further described in U.S. Pat. No. 5,890,241, which is incorporated by reference in its entirety.

Regarding pressure testing of the membrane 125, a different force is applied to the membrane 125 depending on the surface area of the membrane 125. For example, a pressure test of 22 pounds per square inch (PSI) on a 2-inch diameter membrane 125 exerts approximately 69 pounds of force on the membrane 125. Alternatively, the same pressure test of 22 PSI on a 2.5-inch diameter membrane 125 exerts approximately 123 pounds of force on the membrane 125. To sustain greater forces, the membrane 125 may be required or desired to be coupled to the sealing ring assembly 124 on an underside of a lip 126 of the sealing ring assembly 124, during a pressure test. In an example, membranes 125 tested at approximately 22 PSI with thicknesses less than 1 mm may be coupled to the underside of the lip 126 when the diameter of the membrane 125 is greater than 2 inches, greater than 2.1 inches, greater than 2.2 inches, greater than 2.3 inches, greater than 2.4 inches, etc.

The membrane 125 can be removed from the sealing ring assembly 124 (e.g., after pressure testing the installed drain assembly) with a force opposite the direction of the coupling (e.g., friction, adhesive, sonic weld, etc.). In the example shown, the membrane 125 may be removed with a force in a downward direction toward the interior cavity of the sealing ring assembly 124 (e.g., a force opposite in direction of the top surface 105 of the shower drain 102). If the membrane 125 is removed when the shower drain assembly 100 is installed, a downward force onto the membrane 125 may release the coupling (e.g., friction, adhesive, sonic weld, etc.) and the membrane 125 may fall into the interior cavity of the sealing ring assembly 124. A membrane 125 that is no longer coupled to the sealing ring assembly 124 may be grasped and removed from the drain assembly with a tool, such as pliers, or by hand.

Sealing ring assembly 124 may include one or more grooves 127 configured to receive one or more corresponding O-rings 128. O-rings 128 may create a seal between adjacent or nearly adjacent surfaces. For example, O-ring 128-*a* may create a seal between cylindrical surface 113 of the shower drain 102 and the surface(s) of groove 127-*a*, and thus a seal between shower drain 102 and sealing ring assembly 124. In some other examples, O-ring 128-*b* may create a seal between outside surface 129 of pipe 118 and the surface(s) of groove 127-*b*, and thus a seal between pipe 118 and sealing ring assembly 124. Three total O-rings 128, with two disposed on the outside of sealing ring assembly 124 and one disposed on the inside of sealing ring assembly 124, are illustrated, but other configurations may be contemplated with various numbers of O-rings 128 and various placement configurations of the O-rings 128. For example, four total O-rings 128 may be used, with two outside and two inside for sealing ring assembly 124. It should be noted that inside cylindrical surface 130 and outside cylindrical surface 131 of sealing ring assembly 124 may be interrupted by one or more O-rings 128, but such surfaces may still be referred to as cylindrical.

Sealing ring assembly 124 may facilitate fluid leakage testing in various areas of the shower drain assembly 100. In examples an opening 132 is provided in sealing ring assembly 124 to fluidly couple the inside cylindrical surface 132 to the outside cylindrical surface 131 of the sealing ring assembly 124. The opening 132 may comprise a through slot (or duct) formed in the sealing ring assembly 124 between grooves 127-*a* and 127-*b* to facilitate leakage testing. For example, opening 132, at the inside cylindrical surface 130 (e.g., 130-*a* or 130-*b*, or both) of the sealing ring assembly 124, may be fluidly coupled with an inside of the pipe 118 via a gap 133 between the top of the pipe 118 and the membrane 125 and via a gap 134 between the cylindrical outside surface 129 of the pipe 118 and at least a portion of the inside cylindrical surface 130-*a* of the sealing ring assembly 124. For example, during pressure testing, fluid (such as air) may flow from pipe 118 through gap 133 between membrane 125 and the edge of pipe 118. Fluid may flow through gap 134 between inside cylindrical surface 130-*a* and the outside cylindrical surface 129 of pipe 118. Fluid may flow from inside cylindrical surface 130-*a* of the sealing ring assembly 124 through opening 132 to outside cylindrical surface 131 of the sealing ring assembly 124. In this way, the seals of O-rings 128 may be tested, including O-rings on the exterior of sealing ring assembly 124 (such as O-rings 128-*a* and 128-*c*) and O-rings on the interior of sealing ring assembly 124 (such as O-ring 128-*b*). When outside threading 135 of sealing ring assembly 124 is fully coupled with inside threading 112 of shower drain 102 such that the sealing ring assembly 124 presses against retaining ring 119 on ledge 114), there may be gap 133 between test membrane 125 and pipe 118. That is, the test membrane 125 may be longitudinally offset from the top of the pipe 118.

In some examples, inside cylindrical surface 130-*a* of sealing ring assembly 124 may be offset from inside cylindrical surface 130-*b* of sealing ring assembly 124 by the distance of gap 134 or by some other distance, allowing for fluid to flow through gap 134 (e.g., when the outside threading 135 of the sealing ring assembly 124 is coupled with the inside threading 112 of the shower drain 102). Inside cylindrical surface 130-*a* may be radially offset outwardly from inside cylindrical surface 130-*b*. That is, the diameter of a cross section of inside cylindrical surface 130-*a* may be greater than the diameter of a cross section of inside cylindrical surface 130-*b*. In some other examples, inside cylindrical surfaces 130-*a* and 130-*b* may not be radially offset (e.g., their cross sections may have the same diameter), and gap 134 may still exist between outside surface 129 of pipe 118 and inside cylindrical surface 130-*a*. In other examples, the inside cylindrical surface 130-*a* of sealing ring assembly 124 is of substantially the same diameter as the inside cylindrical surface 130-*b* of sealing ring assembly 124, and the gap 134 is maintained by the amount the O-ring 128-*b* protrudes out of groove 127-*b*.

Sealing ring assembly 124 may include a lower surface 136. At least a portion of the lower surface 136 may be angled, for example, at substantially the same angle as that of the angled teeth 123 of retaining ring 119. Lower surface 136 may be configured to frictionally contact retaining ring 119 (e.g., the flat portion of the lower surface 136 may contact the top surface 121 of the flat portion 120 of the retaining ring 119, and the angled portion of the lower surface 136 may contact the one or more angled teeth 123). For example, when outside threading 135 of the sealing ring assembly 124 is coupled with the inside threading 112 of shower drain 102, the lower surface 136 of the sealing ring assembly 124 may be configured to contact the top surface 121 of the retaining ring 119.

Sealing ring assembly 124 may include one or more additional features. For example, sealing ring assembly may include external threading 135, which may couple with internal threading 112 of shower drain 102. In some other examples, sealing ring assembly 124 may include one or more tabs 137 (e.g., holds). Tab(s) 137 may function as a grip for use by a tool or hands to screw sealing ring assembly 124 into or out of shower drain 102. The tab(s) 137 may facilitate rotation of the sealing ring assembly 124 to secure to the shower drain 102 and thus may facilitate installation of the shower drain assembly 100. Tab(s) 137 may be configured to engage a variety of tools readily available to drain installers. For example, tab(s) 137 may be configured to engage handles of a pliers wrench, pliers, or any tool that includes two handles. A tool may be rotated to exert force on the tabs 137 to cause rotation of the sealing ring assembly 124. Additional torque may be provided to rotate the tool by using a second tool, such as a screwdriver, as a lever to rotate the tool. Although two tabs are shown, any number of tabs 137 is appreciated. Example tabs 137, among other components, are discussed in U.S. Patent Pub. No. US-2023-0122714 entitled "Shower Drain and Protective Cover," which is incorporated by reference in its entirety.

Compressible seal 139 may be constructed of a compressible material, such as rubber. The material of compressible seal 139 provides a water-tight seal between receptor 108 and shower pan 101 when the drain assembly 100 is secured to shower pan 101. The compression of the material of compressible seal 139, when compressed against shower pan 101, also provides a frictional force to secure drain assembly 100 about shower pan 101.

The friction gasket 140 is composed of an elastomeric material, such as PVC and/or ABS. In an example, the friction gasket 140 may have a thickness less than 3 mm, less than 2 mm, or less than 1 mm. In a specific example, the friction gasket 140 may have a thickness of approximately 0.020 inches+/−0.003 inches. The friction gasket 140 may provide a friction barrier between the receptor 108 and the compressible seal 139 to mitigate friction on the friction gasket 140 when the receptor 108 moves or rotates. For example, the friction gasket 140 may be rotatable relative to the receptor 108. Continuing this example, when tightening or securing components of the drain assembly 100 about shower pan 101, the friction gasket 140 may reduce bunching and/or pinching of the compressible seal 139 by reducing friction between the receptor 108 and the compressible seal 139. Thus, the friction gasket 140 aids in maintaining the integrity of the compressible seal 139 for proper sealing of the drain assembly about a shower pan.

In examples, during assembly, pipe 118 is set into the floor, and a user may put shower drain 102 on the shower pan 101 and screw in receptor 108 (and compressible seal 139 and friction gasket 140 with receptor 108) up to clamp onto shower pan 101. The user may then drop shower pan 101 down onto pipe 118 so that shower drain 102 fits over pipe 118, place retaining ring 119 between pipe 118 and shower drain 102, and screw in sealing ring assembly 124 between shower drain 102 and pipe 118.

It should be noted that separate, discrete components described herein may be combined to form one or more integrated components, or integrated components may be manufactured as separate components. For example, retaining ring 119 and sealing ring assembly 124 may be manufactured as one integrated component. In another example, gasket 302 and compression ring assembly 310 may be manufactured as one integrated component. Many various combinations of combined and discrete components are contemplated and possible.

Figure 3A:
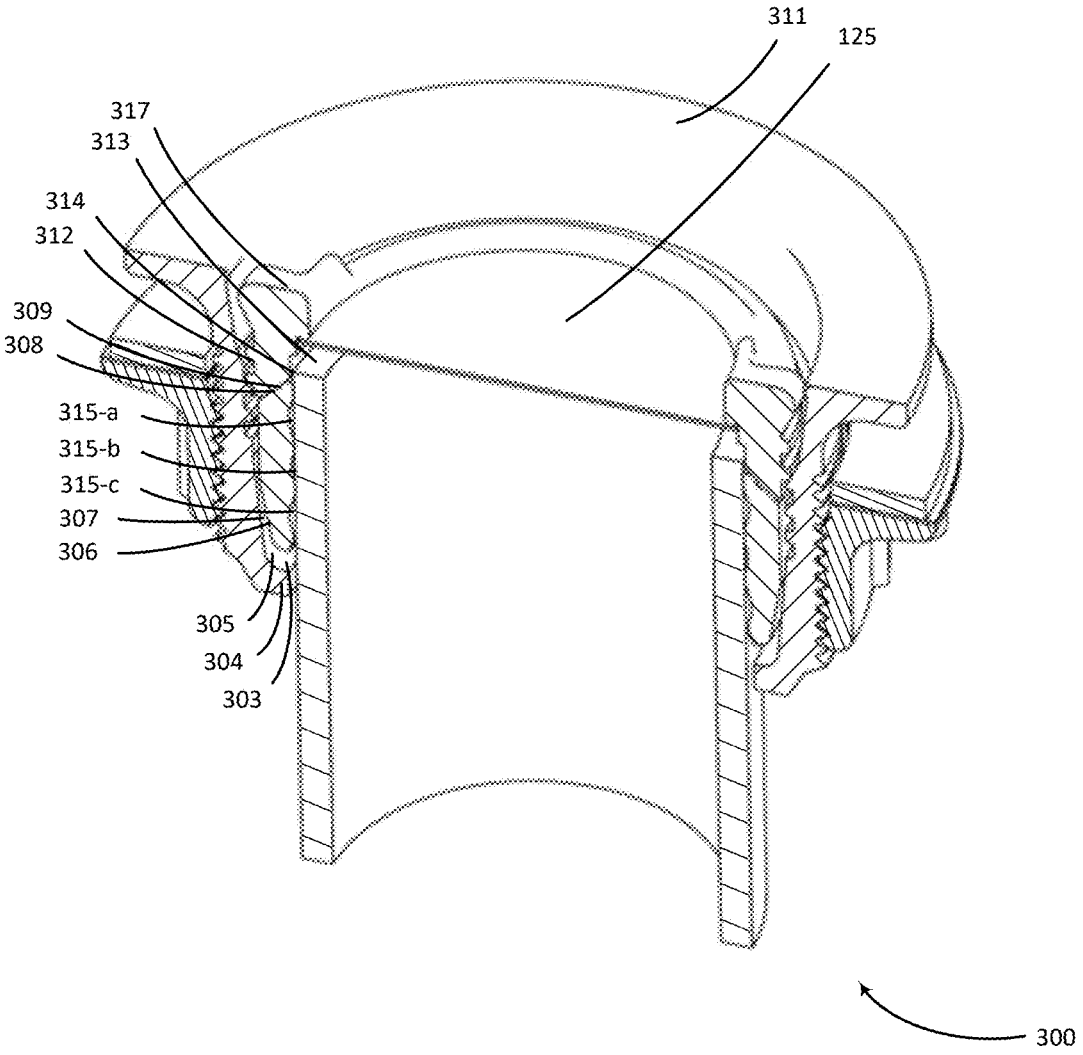
FIG. 3A depicts a cross-sectional, perspective view of a shower drain assembly with multiple components.
Figure 3B:
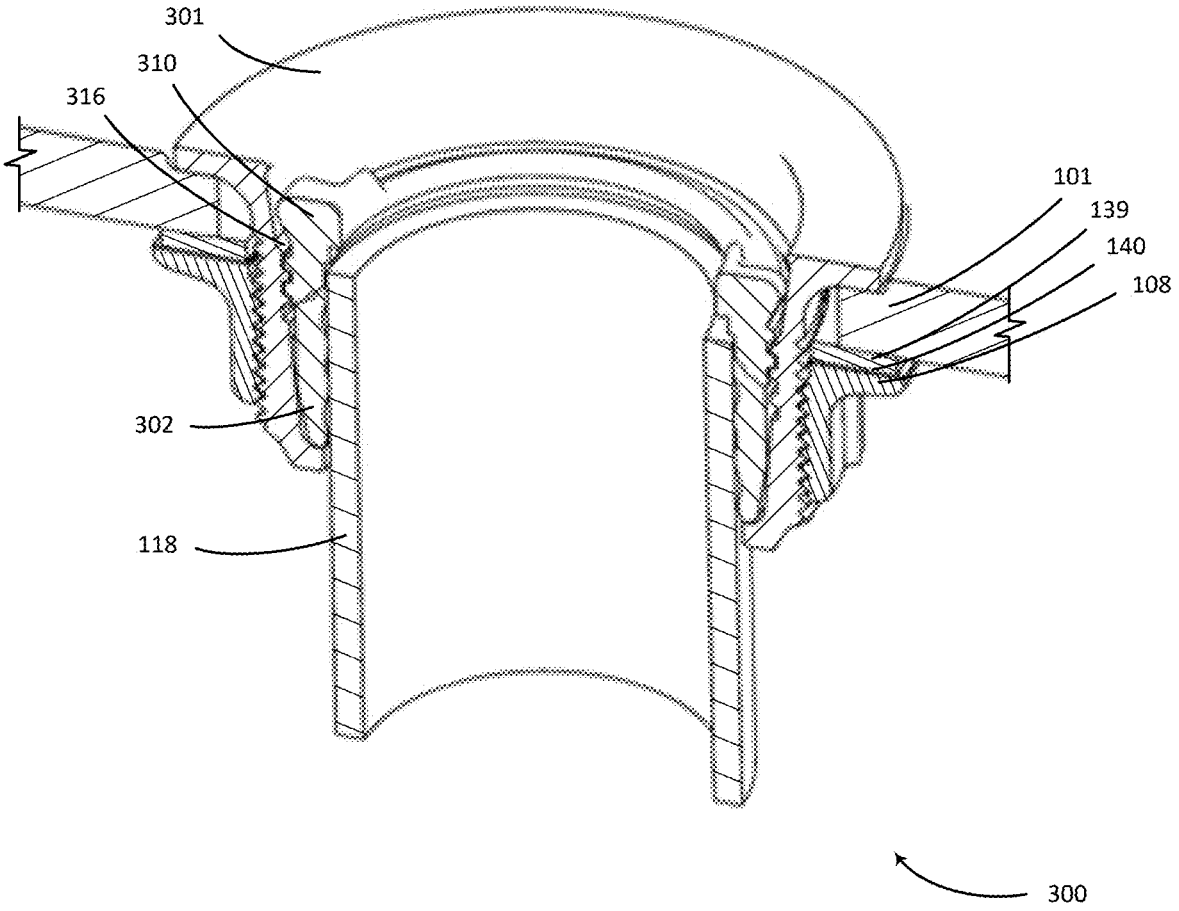
FIG. 3B illustrates a cross-sectional, perspective view of the shower drain assembly of FIG. 3A secured about a shower pan.

FIGS. 3A-3B show diagrams illustrating drain assembly 300 with multiple components. FIG. 3B illustrates drain assembly 300 secured about a shower pan 101. Design modifications to the disclosed systems may also be made to adapt the drain assembly 300 to be secured about a tile shower or other securing surface other than shower pan 101. With regard to FIG. 3B, repeated discussion of similar features will be omitted for brevity.

Figure 4:
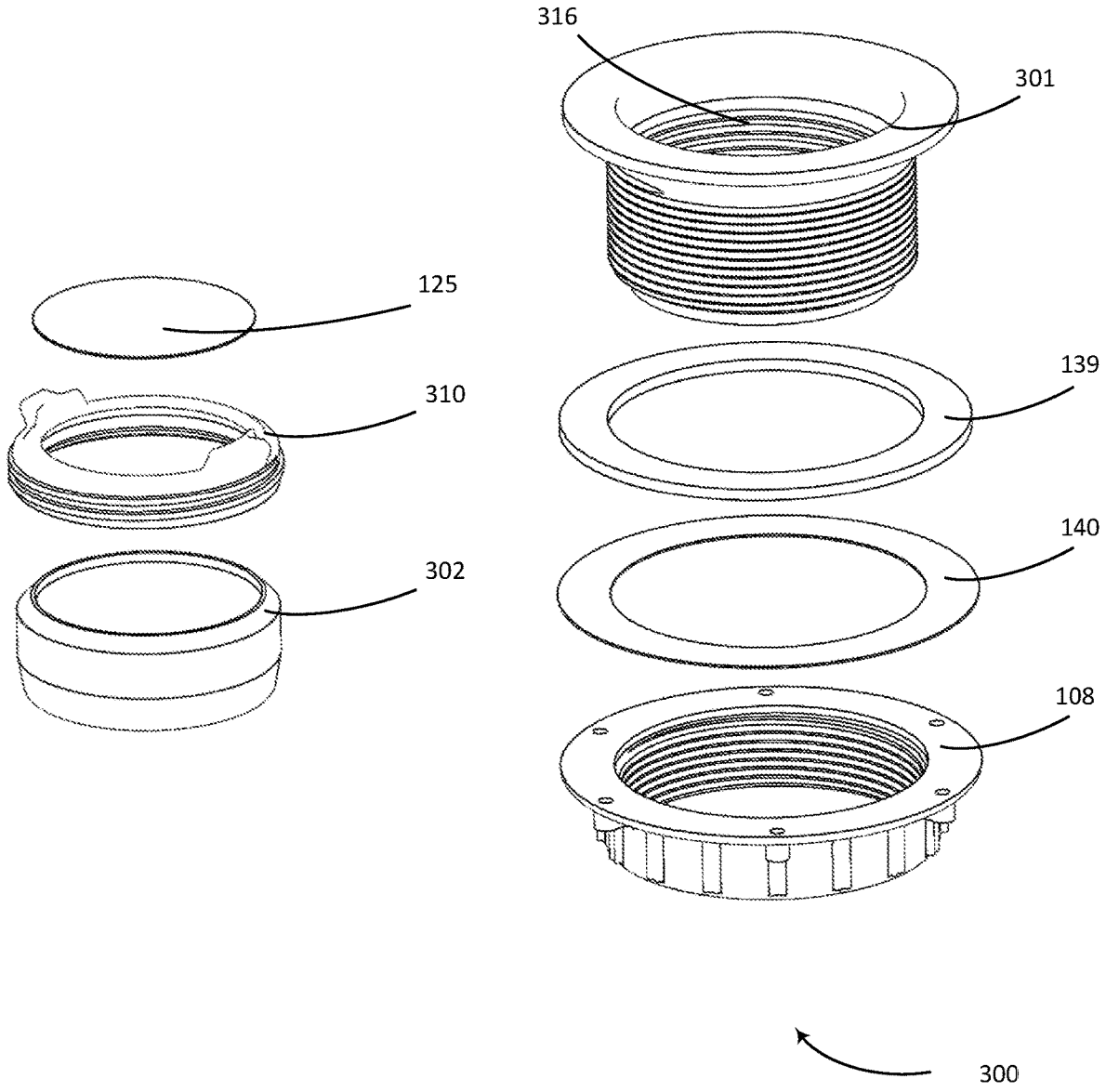
FIG. 4 shows an exploded view of one or more components for the drain assembly of FIG. 3A.

FIG. 4 shows an exploded view of one or more components for the drain assemblies of FIGS. 3A-3B. Repeated discussion of similar features will be omitted for brevity.

Referring concurrently to FIGS. 3A, 3B, and 4, shower drain assembly 300 may include a shower drain 301. Some aspects of shower drain 301 may be similar to or the same as those of shower drain 102. In some cases, surface 307 and ledge 304 of shower drain 301 may be different compared to features in shower drain 102, as will be discussed.

Shower drain assembly 300 may include a gasket 302. Gasket 302 may be composed of one or more materials, including rubber, other soft materials (e.g., foam, sponge, cork), metal, plastic (e.g., Teflon, polyethylene (PE), polypropylene (PP), PVC, polyurethane (PE), acetal (Delrin), polycarbonate (PC), nylon), silicone, ceramic, or the like, or a combination of these. Gasket 302 may have a substantially cylindrical shape. Gasket 302 may be configured to be frictionally inserted into shower drain 301. For example, at least a portion of bottom surface 303 of gasket 302 may be configured to contact ledge 304 when fully installed. In some cases, ledge 304 may be different from ledge 114 or may include ledge 114. For example, ledge 304 may include a curved surface 305. At least a portion of outside surface 306 of gasket 302 may be configured to contact surface 307 of shower drain 301. Top surface 308 of gasket 302 may be configured to contact bottom surface 309 of compression ring assembly 310 (e.g., when outside threading 312 of compression ring assembly 310 is coupled to the inside threading 316 of the shower drain 301) at an angle. Top surface 308 of gasket 302 may be angled (e.g., angled relative to the flat top surface 311 of shower drain 301). The angles of top surface 308 of gasket 302 and the bottom surface 309 of the compression ring assembly 310 may be similar or the same. In some examples, the angles of the top surface 308 of gasket 302 and the bottom surface 309 of the compression ring assembly 310 may be angled upwards with respect to the center of pipe 118. The gasket 302 may also include several grooves 315, such as grooves 315-*a*, 315-*b*, and 315-*c*, on an interior wall of the gasket 302. The grooves may be concentric with an upper opening and lower opening of the shower drain 311 and compression ring assembly 310. The grooves 315 provide space for gasket 302 to deform when compressed by downward movement of the compression ring assembly 310 when outside threading 312 of the compression ring assembly 310 is threadingly coupled with the inside threading 316 of shower drain 301.

Shower drain assembly 300 may include a compression ring assembly 310. In some cases, compression ring assembly 310 may include one or more similar features as sealing ring assembly 124. For example, compression ring assembly 310 may include similar or the same features as the upper part 138 of the sealing ring assembly 124. Compression ring assembly 310 may include a bottom surface 309. Bottom surface 309 may be angled (e.g., angled relative to top surface 311 of shower drain 301).

In some examples, shower drain assembly 300 may be configured to support fluid testing of one or more portions of shower drain assembly 300. For example, during fluid testing, fluid may flow through pipe 118, and may be stopped by test membrane 125. In some examples, there may be a gap 313 between the test membrane 125 and the top of the pipe 118 (e.g., the test membrane 125 may be longitudinally offset from the top of the pipe 118 by gap 313).

In some examples, there may also be a gap 314 between the compression ring assembly 310 and the pipe 118 (e.g., an outside surface of the pipe 118) (e.g., when the outside threading 312 of the compression ring assembly 310 is coupled with the inside threading 316 of the shower drain 301). Fluid may flow from pipe 118 and through gaps 313 and 314, to gasket 302 to test the seal of the gasket.

Generally, compression ring assembly 310 exerts a downward force on gasket 302 to form a seal with gasket 302 as the outside threading 312 of the compression ring assembly 310 is threadingly coupled with the inside threading 316 of shower drain 301. The downward force causes the gasket 302 to slide down the edge of the pipe 118 before making contact with the ledge 304 of the shower drain 301. The downward force also causes gasket 302 to form a seal with compression ring 310 and pipe 118 (e.g., due to the force exerted by the compression ring assembly 310 at the angle of top surface 308 of gasket 302 when outside threading 312 is threadingly mated with inside threading 316. In examples, better compression force may be achieved with this design, as the angled top surface 308, angled bottom surface of the compression ring assembly 310, and the groove 315-*a* cooperate to concentrate the compression force into a relatively small contact patch between the compression ring assembly 110, the gasket 302 and the pipe 118. As the gasket is deformed by the downward movement of the compression ring assembly 310, gasket 302 is also forced against surface 307 to form a seal with surface 307 of shower drain 301. In some cases, the seal between a top portion of gasket 302 and pipe 118 may be damaged, and additional seals (e.g., where the gasket 302 between grooves 315-*a*, 315-*b*, 315-*c* contact the pipe) may serve as back up seals between gasket 302 and pipe 118. The seal between compression ring assembly 310, gasket 302, and pipe 118 may be tested by pressurizing fluid in the pipe 118 while the membrane 125 is still attached to the compression ring assembly 310, as previously described.

Compression ring assembly 310 may include one or more tabs 317. Tab(s) 317 may function as a grip for use by a tool or hands to screw compression ring assembly 310 into or out of shower drain 301. The tab(s) 317 may facilitate rotation of the compression ring assembly 310 to secure to the shower drain 102 and thus may facilitate installation of the shower drain assembly 100. Tab(s) 317 may be configured to engage a variety of tools readily available to drain installers. For example, tab(s) 317 may be configured to engage handles of a pliers wrench, pliers, or any tool that includes two handles. A tool may be rotated to exert force on the tabs 317 to cause rotation of the compression ring assembly 310. Additional torque may be provided to rotate the tool by using a second tool, such as a screw driver, as a lever to rotate the tool. Although two tabs are shown, any number of tabs 317 is appreciated.

During assembly, pipe 118 is set into the floor, and a user may put shower drain 301 on the shower pan 101 and screw in receptor 108 (and compressible seal 139 and friction gasket 140 with receptor 108) up to clamp onto shower pan 101. The user may then drop shower pan 101 down onto pipe 118 so that shower drain 301 fits over pipe 118, place gasket 302 between pipe 118 and shower drain 301, and screw in compression ring assembly 310 between shower drain 301 and pipe 118.

It should be noted that test membrane 125 in FIGS. 3A, 3B, and 4 may have similar or the same aspects as those previously described. In some examples, compression ring assembly 310 and membrane 125 may be made from a same material, may form a single integrated part (e.g., may be made as one piece), or both. For example, compression ring assembly 310 and membrane 125 may be plastic molded as a single integrated part (e.g., with a groove/break line) to be broken apart once a pressure test is complete.

Although the present disclosure discusses the implementation of these techniques in the context of a drain assembly for a shower, the technology introduced above may be implemented for a variety of drainage needs. A person of skill in the art will understand that the technology described in the context of securing a drain assembly to a shower pan could be adapted for use with other systems such as a bathtub, a sink, shower tiles, etc. Additionally, a person of ordinary skill in the art will understand that the drain assembly may be implemented or installed with a variety of setups.

Those skilled in the art will recognize that the methods and systems of the present disclosure may be implemented in many manners and as such are not to be limited by the foregoing aspects and examples. In this regard, any number of the features of the different aspects described herein may be combined into single or multiple aspects, and alternate aspects having fewer than or more than all of the features herein described are possible. Functionality may also be, in whole or in part, distributed among multiple components, in manners now known or to become known.

Moreover, the scope of the present disclosure covers conventionally known manners for carrying out the described features and functions, and those variations and modifications that may be made to the components described herein as would be understood by those skilled in the art now and hereafter. In addition, some aspects of the present disclosure are described above with reference to block diagrams and/or operational illustrations of systems and methods according to aspects of this disclosure. The functions, operations, and/or acts noted in the blocks may occur out of the order that is shown in any respective flowchart. For example, two blocks shown in succession may in fact be executed or performed substantially concurrently or in reverse order, depending on the functionality and implementation involved.

Further, as used herein and in the claims, the phrase "at least one of element A, element B, or element C" is intended to convey any of: element A, element B, element C, elements A and B, elements A and C, elements B and C, and elements A, B, and C. In addition, one having skill in the art will understand the degree to which terms such as "about" or "substantially" convey in light of the measurements techniques utilized herein. To the extent such terms may not be clearly defined or understood by one having skill in the art, the terms "about" and "substantially" shall mean plus or minus ten percent or, if in relation to an angle, plus or minus ten degrees.

Numerous other changes may be made which will readily suggest themselves to those skilled in the art and which are encompassed in the spirit of the disclosure and as defined in the appended claims. While various aspects have been described for purposes of this disclosure, various changes and modifications may be made which are well within the scope of the disclosure. Numerous other changes may be made which will readily suggest themselves to those skilled in the art and which are encompassed in the spirit of the disclosure and as defined in the claims.

What is claimed is:

1. A shower drain assembly, comprising:

a shower drain comprising:

an upper opening;

a lower opening;

a ledge having an upper surface and being substantially concentric with the upper opening and the lower opening of the shower drain;

and inside threading;

a retaining ring comprising a plurality of angled teeth, and wherein the retaining ring is configured to rest on the upper surface of the ledge of the shower drain; and a sealing ring assembly, the sealing ring assembly comprising:

a test membrane;

outside threading configured to couple to the inside threading of the shower drain;

a plurality of grooves substantially concentric with the upper opening and the lower opening of the shower drain, each configured to receive an O-ring;

an inside cylindrical surface;

an outside cylindrical surface; and an opening through the sealing ring assembly extending radially from the inside cylindrical surface to the outside cylindrical surface, wherein a lower surface of the sealing ring assembly is configured to contact the retaining ring when the sealing ring assembly is threadingly mated to the shower drain.

2. The shower drain assembly of claim 1, wherein the sealing ring assembly further comprises a lower opening configured to receive a pipe, and wherein when the sealing ring assembly is threadingly mated with the shower drain, there is a first gap between the top of the pipe and the test membrane of the sealing ring assembly.

3. The shower drain assembly of claim 2, wherein the pipe comprises a cylindrical outside surface, and wherein when the sealing ring assembly is threadingly mated with the shower drain, there is a second gap between the cylindrical outside surface of the pipe and at least a portion of the inside cylindrical surface of the sealing ring assembly.

4. The shower drain assembly of claim 3, wherein the inside cylindrical surface of the sealing ring assembly is divided into a first surface and a second surface, wherein the first surface is radially offset from the second surface, and wherein the second gap is between the cylindrical outside surface of the pipe and the first surface of the inside cylindrical surface of the sealing ring assembly.

5. The shower drain assembly of claim 2, further comprising a plurality of O-rings, wherein the plurality of O-rings comprises a first-O-ring configured to contact the shower drain and the sealing ring assembly to create a first seal, and a second O-ring configured to contact the pipe and the sealing ring assembly to create a second seal.

6. The shower drain assembly of claim 2, wherein the pipe comprises a cylindrical outside surface, and wherein the opening, at the inside cylindrical surface of the sealing ring assembly, is fluidly coupled with an inside of the pipe via the first gap and via a second gap between the cylindrical outside surface of the pipe and at least a portion of the inside cylindrical surface of the sealing ring assembly.

7. The shower drain assembly of claim 1, wherein the opening, at the outside cylindrical surface of the sealing ring assembly, is located between two of the grooves, including at least one outwardly facing groove and at least one inwardly facing groove.

8. The shower drain assembly of claim 1, wherein the sealing ring assembly comprises one or more holds.

9. The shower drain assembly of claim 1, where the sealing ring assembly has a lower surface at an angle that is substantially a same angle as the plurality of angled teeth.

* * * * *